US007716782B2

(12) United States Patent
Terrien et al.

(10) Patent No.: US 7,716,782 B2
(45) Date of Patent: May 18, 2010

(54) MOBILE UNIT FOR CLEANING A SEWER NETWORK

(75) Inventors: Cyril Terrien, Le Perreux sur Marne (FR); Eric Gaudy, La Chapelle sur Erdre (FR)

(73) Assignee: Veolia Eau - Compagnie Generale Des Eaux, Paris (FR)

( * ) Notice: Subject to any disclaimer, the term of this patent is extended or adjusted under 35 U.S.C. 154(b) by 80 days.

(21) Appl. No.: 11/943,760

(22) Filed: Nov. 21, 2007

(65) Prior Publication Data

US 2008/0115314 A1 May 22, 2008

(30) Foreign Application Priority Data

Nov. 21, 2006 (FR) ..... 06 55019

(51) Int. Cl.
*A47L 7/00* (2006.01)

(52) U.S. Cl. ..... 15/320; 15/302; 15/314; 15/321

(58) Field of Classification Search ..... 15/302, 15/314, 320, 321
See application file for complete search history.

(56) References Cited

U.S. PATENT DOCUMENTS 4,134,174 A * 1/1979 Flynn et al. ..... 15/302
4,199,837 A * 4/1980 Fisco, Jr. ..... 15/302
4,645,084 A * 2/1987 Deike ..... 212/271

FOREIGN PATENT DOCUMENTS

DE 29 48 780 A1 6/1981
DE 43 35 188 A1 4/1995
DE 299 09 623 U1 9/1999

OTHER PUBLICATIONS

International Search Report dated Jun. 27, 2007.

* cited by examiner

*Primary Examiner*—Joseph J Hail, III
*Assistant Examiner*—Shantese McDonald
(74) *Attorney, Agent, or Firm*—Townsend and Townsend and Crew LLP

(57) ABSTRACT

The invention relates to a mobile unit for cleaning a sewer network from a manhole, the unit comprising a suction hose, a cleaner hose, and a support and guide arm comprising a horizontal portion movable in swiveling about a vertical axis and in horizontal translation relative to the mobile unit, said arm further including a vertical portion connected to the horizontal portion and presenting a bottom module movable in swiveling and in vertical translation relative to said horizontal portion, the suction and cleaner hoses being connected to said bottom module, whereby the positioning of the bottom module corresponds substantially to the positioning of the working ends of the suction and cleaner hoses.

19 Claims, 8 Drawing Sheets

MOBILE UNIT FOR CLEANING A SEWER NETWORK

BACKGROUND OF THE INVENTION

The term mobile unit covers both a self-propelled assembly such as a wheeled vehicle of the truck type, and an assembly that itself towed, such as a trailer, a wagon, or indeed an assembly suitable for mounting on a trailer or on the chassis of a vehicle.

There exists trucks, known as jetter-trucks, that can be used for applying both a water-jet and suction to sewer networks, i.e. for enabling the deposits that accumulate in manholes and the adjacent channels to be removed by means of a cleaner hose having a cleaner head that delivers a high-pressure water-jet, and by means of a suction hose for sucking up the liquid residue and sludge.

It will be understood that equipment of that type must enable the operator, who remains close to the manhole situated in a roadway, to place the cleaner hose with the cleaner head at its end in the manhole in the desired location(s), to hold it in position throughout the high-pressure cleaning operation while causing water to be delivered at high pressure, and then to raise it back onto the truck. Thereafter, the operator needs to perform the same positioning, control, retention, and raising operations using the suction hose.

From the above, it can thus be understood that the operator needs to perform a large amount of handling while not having a good view of the position inside the manhole, and thus while not guaranteeing that cleaning will be performed properly and that no zones will be left unwashed and/or with debris that has not been sucked up.

Furthermore, in particular when raising the hoses, and more particularly the cleaner hose, splashing can arise outside the manhole that, combined with possible dirtying of the hoses, can lead to situations and to handling difficulties that can sometimes be most uncomfortable for the operator.

Document DE 102 46 041 discloses a cleaning vehicle having an arm mounted on the vehicle that is movable relative to the vehicle to swivel about a vertical axis and to move in horizontal translation, the arm carrying a suction hose and a cleaner hose.

Document EP 0 698 696 also discloses a cleaning vehicle fitted with a high-pressure cleaner hose and a suction hose mounted on a horizontal-swiveling telescopic boom.

Nevertheless, it is desirable to achieve greater accuracy in the positioning of the suction and cleaner hoses, in particular over the manhole, and in particular close to the manhole, and in the manhole, both vertically (height/depth) and in a radial direction about a vertical axis running along the manhole.

OBJECTS AND SUMMARY OF THE INVENTION

An object of the present invention is to provide a mobile unit for cleaning a sewer network that enables the drawbacks of the prior art to be overcome, and in particular that makes it possible to facilitate accurately positioning the working ends of the suction and cleaner hoses at each step, i.e. while putting the hoses into place, while the hoses are working, and then while extracting the hoses from the manhole.

To this end, the present invention provides a mobile unit for cleaning a sewer network from a manhole, the unit comprising:

- a suction hose mounted on a reel and connected to a collection tank and to a suction pump;

- a high-pressure cleaner hose mounted on a reel and connected to a water tank, to a high-pressure pump, and to a cleaner head;
- a support and guide arm for supporting and guiding the suction hose and the cleaner hose, said arm comprising a horizontal portion connected to the mobile unit and being movable to swivel about a vertical axis and in horizontal translation relative to the mobile unit so as to enable the working ends of the suction and cleaner hoses to be positioned above the sewer manhole, said arm further comprising a vertical portion connected to the horizontal portion and presenting a bottom module that is movable in swiveling and in vertical translation relative to said horizontal portion;

the suction and cleaner hoses being connected to said bottom module, whereby the positioning of the bottom module corresponds substantially to the positioning of the working ends of the suction and cleaner hoses.

In this way, it will be understood that the various degrees of freedom of the support and guide arm make it possible to obtain great accuracy in the positioning of the suction hose and of the cleaner hose carried by said support and guide arm.

Because of the equipment provided in the horizontal portion of the arm, the entire arm can be pivoted about a vertical axis and its entire vertical portion can move in horizontal translation relative to the mobile unit.

In addition, in a manner specific to the invention, the vertical portion of the arm includes arrangements that enable the bottom module at its bottom end to move both in swiveling about its vertical axis and in vertical translation.

In this way, it will be understood that it is easy to move the bottom module into the desired position, and thus to move the working ends of the suction and cleaner hoses into position inside the manhole.

This solution also presents an additional advantage of avoiding untimely movement of the suction and cleaner hoses, and in particular of avoiding the end of the cleaner hose fitted with the cleaner head rising and striking the operator, or indeed of avoiding the cleaner hose suffering wear by rubbing against the wall of the manhole or of the channels leading thereto.

Overall, because of the solution of the present invention, the work of the operator can be made much easier so as to become more accurate and less tiring, thereby providing greater effectiveness in cleaning operations.

The connection between the horizontal portion and the vertical portion of the arm preferably forms a bend hinged by means of a ball joint that accommodates relative angular movement between the horizontal portion and the vertical portion up to a maximum of 5°, and preferably of 3°.

Advantageously, the horizontal portion of the arm includes first drive means and a first swivel joint enabling said swiveling movement about a vertical axis relative to the mobile unit, the horizontal portion of the arm further including second drive means and a plurality of beams nested in one another and suitable for performing said horizontal translation movement of the horizontal portion of the arm by telescopic displacement between the beams, under drive from said second drive means. For example, the second drive means may comprise a hydraulic actuator situated in a central position within the set of nested beams.

In a preferred disposition, the vertical portion of the horizontal arm further includes a top module that is connected to the horizontal portion and that presents third drive means suitable for driving the vertical translation movement of the bottom module. These third drive means may comprise, for example, an electric winch associated with a cable and capable of being declutched so as to make manual control possible. Other embodiments could be provided for the third drive means, such as using a control actuator.

Under such circumstances, and advantageously, the vertical portion of the arm further includes a second swivel joint having a ring and fourth drive means for driving swiveling movement about a vertical axis of the bottom module. By way of example, these fourth drive means comprise a motor controlling the second swivel joint so as to enable the vertical arm to turn, the ring possibly taking a variety of forms including a ring with rolling bearings, with segments, . . . .

Furthermore, under such circumstances, it is preferable to provide for the vertical portion of the arm to further include an intermediate module situated between the bottom module and the top module, being connected to the ring of the second swivel joint, and comprising a plurality of beams nested in one another and suitable for performing said vertical translation movement of the vertical portion of the arm by telescopic movement between the beams driven by said third drive means of the top portion, whereby the bottom module is driven with the same vertical translation movement, one of the beams of the intermediate module being fastened to the ring of the second swivel joint.

In another preferred disposition, the suction hose is detachably connected to said vertical portion of the arm. For example, the free end of the suction hose can be housed telescopically in a sheath connected to the vertical portion of the arm.

Thus, and preferably, the bottom module is provided with a ring enabling the suction hose to be held so that it follows the movements of the bottom module.

In general, provision is advantageously made for the bottom module to enable the suction hose to be offset about the cleaner hose with radial indexing. Such a disposition makes it possible, for example, to clean zones adjacent to the invert (flow channel) and facing the manhole, such as sidewalks.

In an embodiment, the suction hose can be turned in rotation with indexing by a ring relative to an extension of the beams of the intermediate module.

According to another preferred characteristic, the horizontal and vertical portions of the arm are provided with a system for guiding the suction hose and/or the cleaner hose via roller elements.

Advantageously, the bottom module further includes a camera module making it possible from the bottom module to view the inside of the manhole and the adjacent channel zones. Such a disposition makes it easier to carry out diagnosis before performing treatment by water-jetting, and/or to inspect the state of the installation after the water-jetting treatment. Under such circumstances, and advantageously, said camera module is connected to a data acquisition and/or display system by means of a cable running along the support and guide arm. It is thus possible to transmit the information picked up by the camera to the data acquisition and/or display system so as to make it possible to perform inspections and verifications remotely or at a later time, and in particular for them to be performed by a different operator.

Alternatively, or in addition to the camera module that remains connected to the bottom module, the bottom module may further include a support suitable for receiving an autonomous carriage fitted with a mobile camera. Under such circumstances, the mobile camera can move within the network and pick up visual information relating to zones other than those situated directly vertically in line with or close to the manhole.

Preferably, the bottom module further includes a deployable presser member suitable for coming into contact with the structure of the manhole. Such a member serves to make it easier to position the suction and cleaner hoses accurately and to avoid any untimely movement caused by the water pressure when water is ejected under high pressure for cleaning purposes. By way of example, this member is constituted by a deployable sleeve within which the working end of the cleaner hose carrying the cleaner head is guided.

Advantageously, the mobile unit further includes a protection bell movable in vertical translation about the vertical portion of the arm and suitable for surrounding the arm over the manhole.

In this way, the bell closes the manhole for the operator, thereby protecting the operator from any splashing and possible additional odors generated by the cleaning operations using water-jetting and suction, while also making it possible to move the arm (in particular in vertical translation for the vertical portion of the arm). It will be understood that the bell, which preferably forms part of the intermediate module, provides the operator with protection both in terms of hygiene and reducing health risks, and also more generally in terms of safety. Furthermore, provision may advantageously be made for the up/down movement of the bell to be servo-controlled to the movement of the cleaner hose.

In another preferred possibility, the protection bell further includes a camera module movable at least vertically relative to the support and guide arm and enabling the inside of the manhole and adjacent channel zones to be viewed. Under such circumstances, it should be understood that the camera module of the bell acts as the above-mentioned optional camera module of the bottom module. In this way, by means of the camera module that is housed at rest in the bell, means are made available for exploring and viewing the manhole and its surroundings. The camera module is preferably independent of the support and guide arm in terms of control and movement, for example by using a system that enables it to move with reversible vertical telescopic movement.

The present invention also provides a vehicle including a mobile cleaner unit as set out above.

BRIEF DESCRIPTION OF THE DRAWINGS

Other advantages and characteristics of the invention appear on reading the following description made by way of example and with reference to the accompanying drawings, in which.

MORE DETAILED DESCRIPTION

Figure 1:
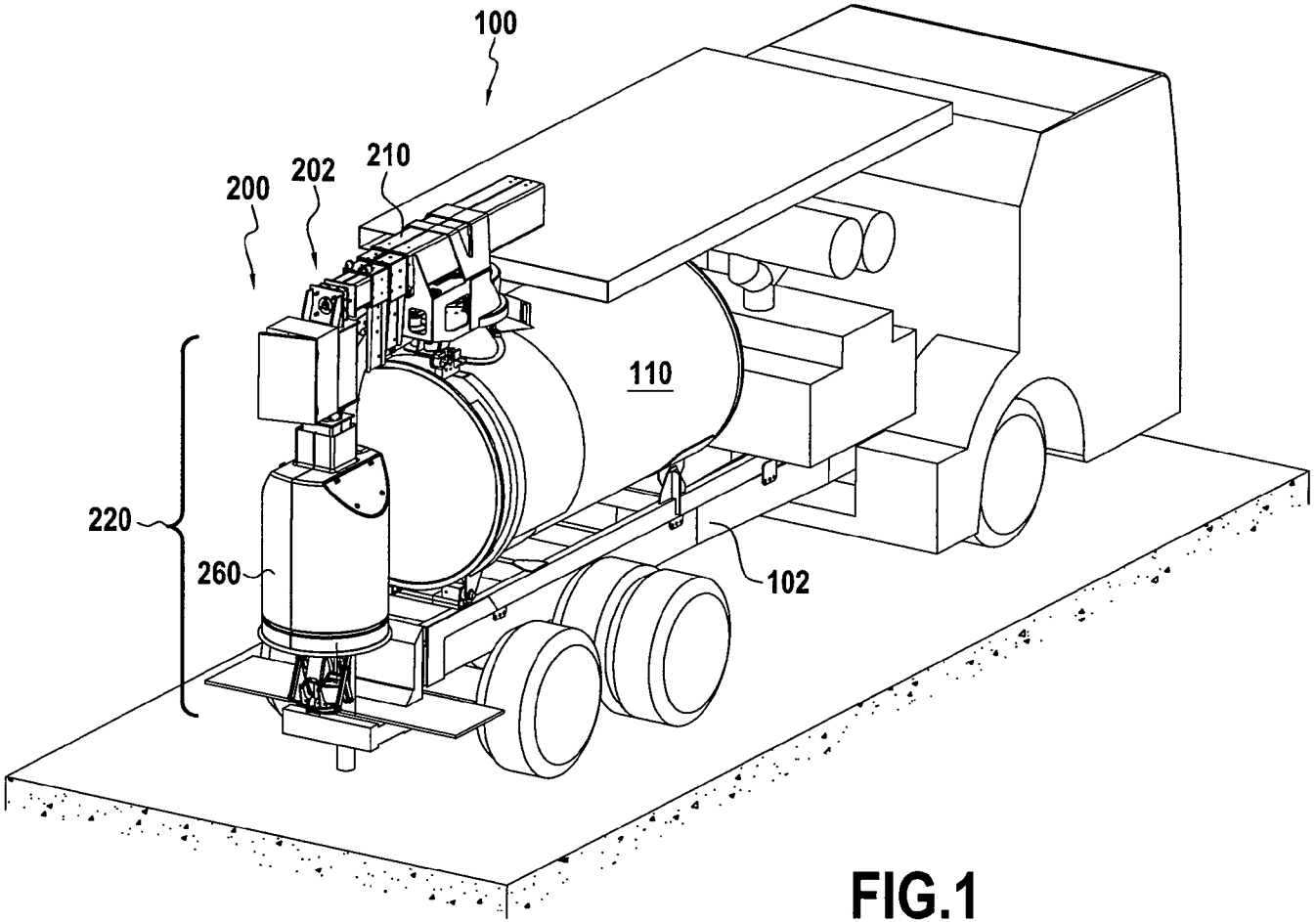
FIG. 1 is a general perspective view of a vehicle carrying a mobile unit in accordance with the present invention.

In FIG. 1, a vehicle 100 carries on its rear chassis 102 cleaning equipment including one (or more) tank(s) 110 together with a mobile unit 200.

The mobile unit 200 comprises a support and guide arm 202 constituted by a horizontal portion 210 that extends horizontally over the top portion of the rear of the vehicle 100, and a vertical portion 220 that extends vertically to form the rear end of the vehicle 100.

In FIG. 1, the mobile unit 200 is shown in its rest position that allows the vehicle 100 to move, since all of the mobile portions, as described below, are retracted.

Figure 2:
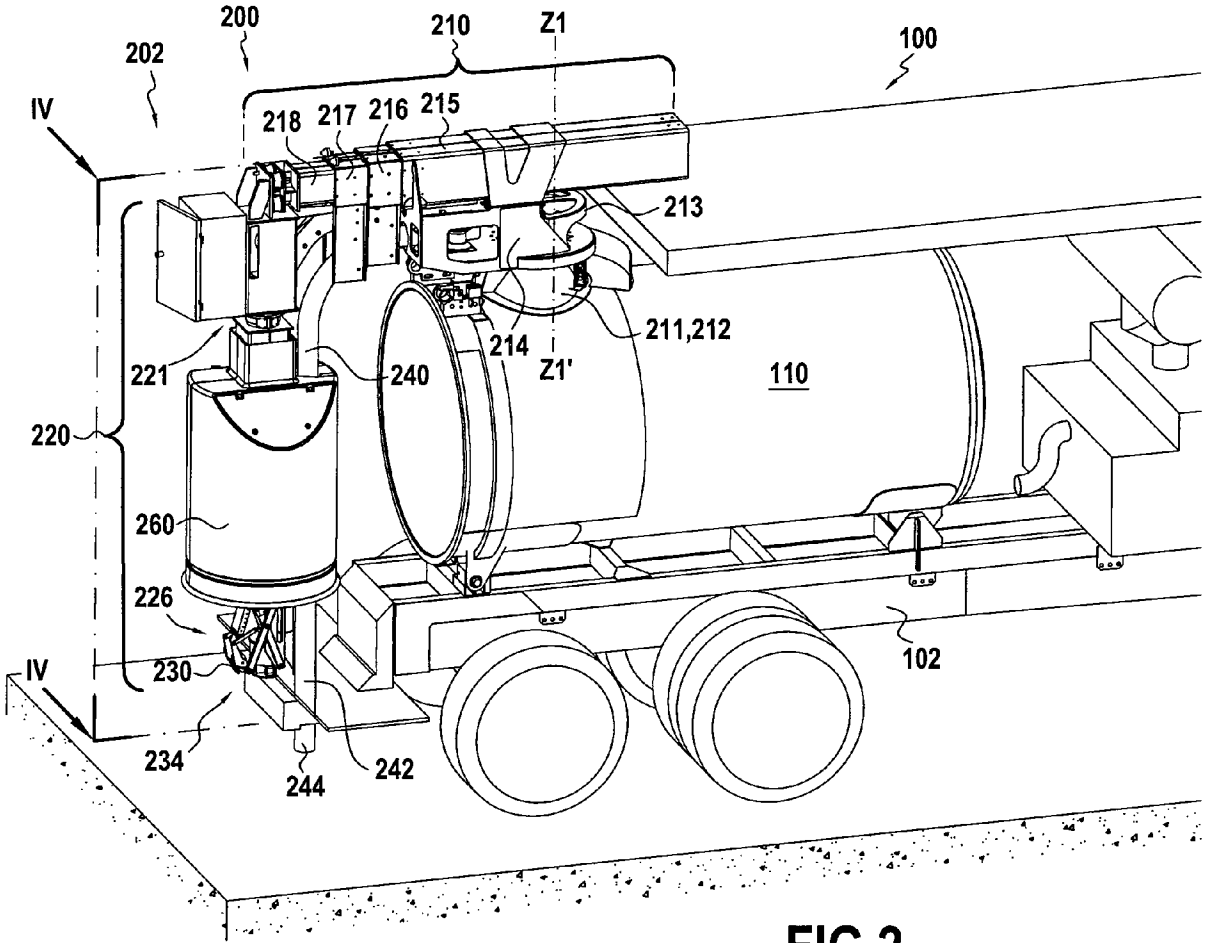
FIG. 2 is an enlarged perspective view of the rear portion of the vehicle visible in FIG. 1.

The mobile unit 200 is more clearly visible in FIG. 2 where all of the component parts of the horizontal portion 210 and of the vertical portion 220 of the support and guide arm 202 can be seen more clearly.

To perform water-jet cleaning, the mobile unit 200 is fitted firstly with a cleaner hose 230 having a cleaner head 234 at its terminal working end 232, and secondly a suction hose 240 formed with a cylinder 242 (see FIGS. 2 and 6) at its terminal working end.

Figure 4:
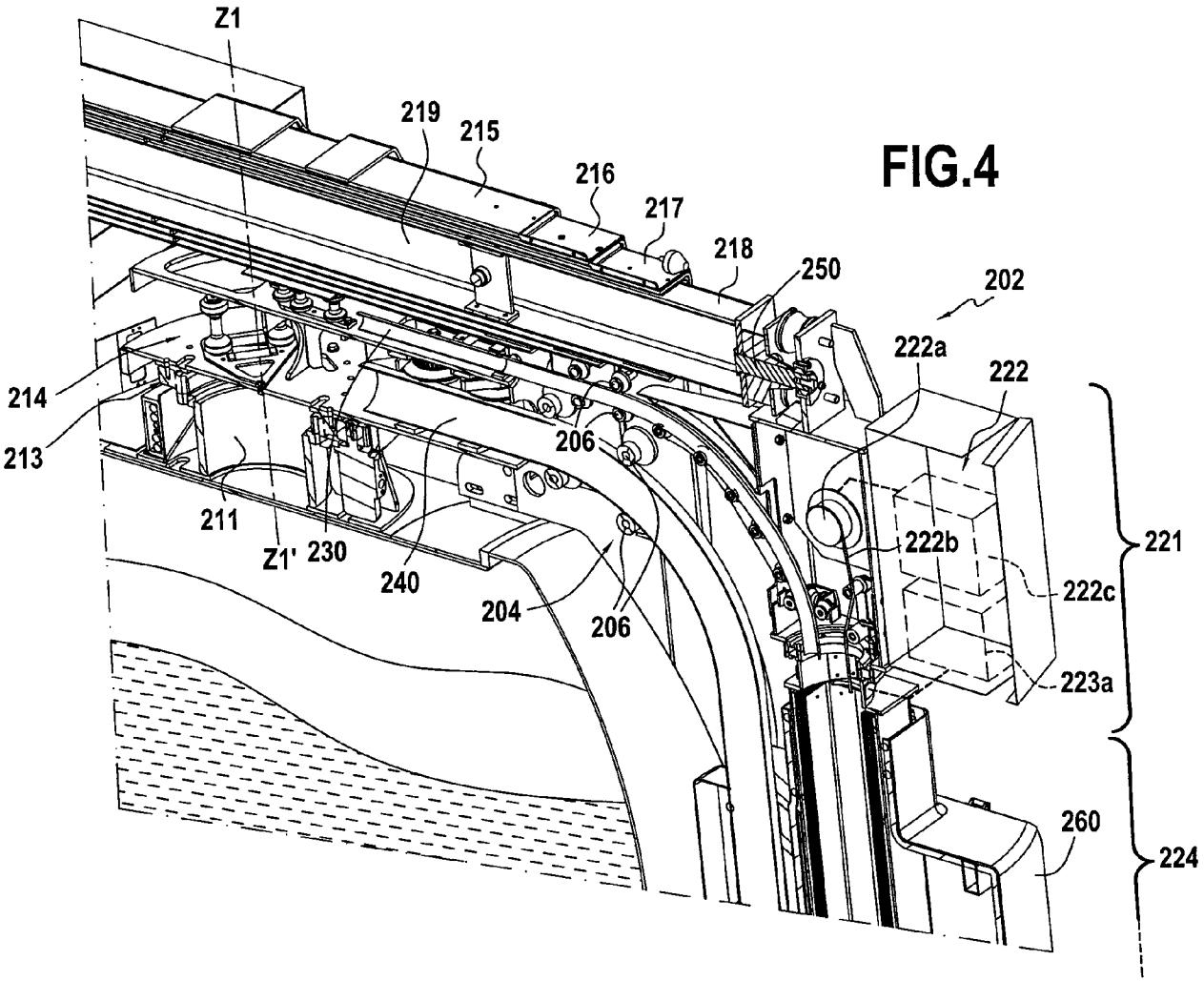
FIG. 4 is a section view in perspective of the zone connecting the horizontal portion to the vertical portion of the support and guide arm.
Figure 5:
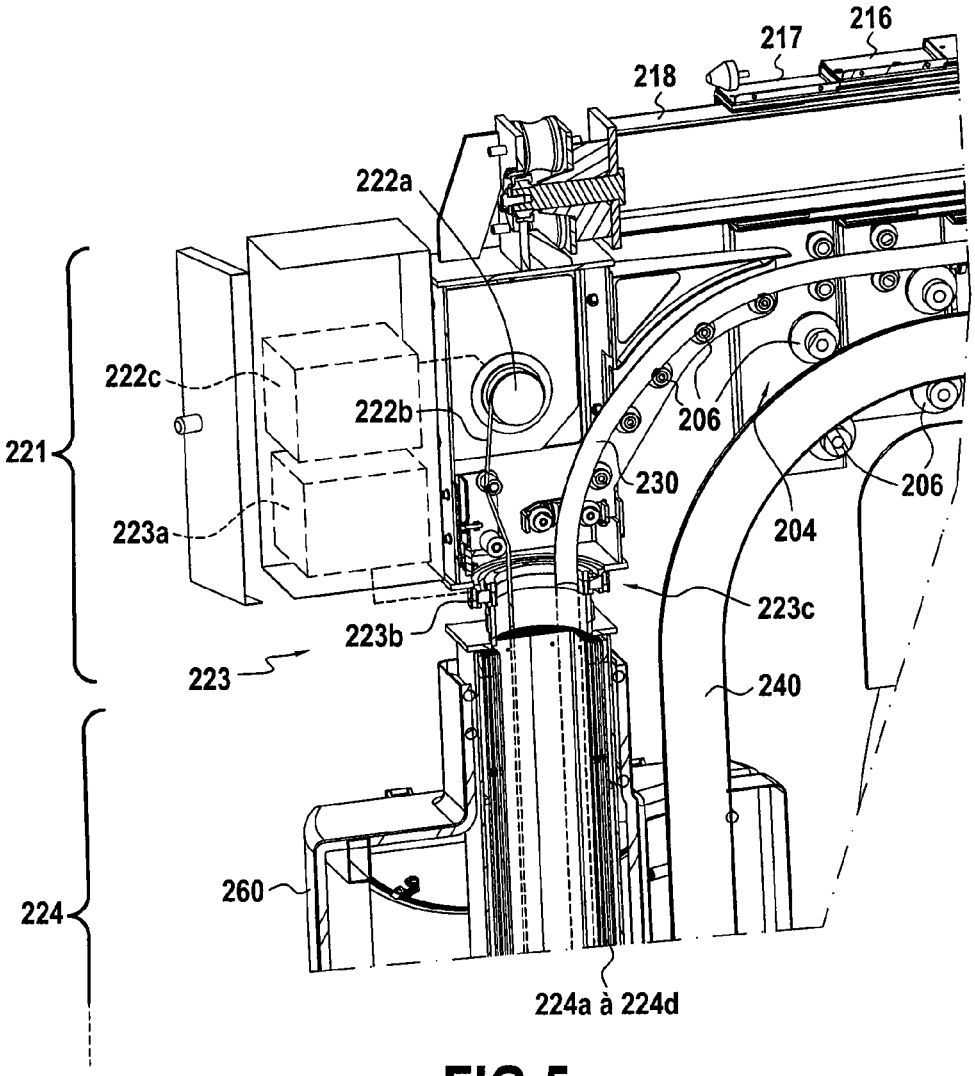
FIG. 5 is a section view showing the top end of the vertical portion of the support and guide arm.

The cleaner hose 230 and the suction hose 240 are supported by the arm 202, along the horizontal portion 210 and along the vertical portion 220 by a guide system 204 having roller elements 206, preferably constituted by grooved wheels (see FIGS. 4 and 5). Some of the roller elements 206 are drive elements suitable for driving the hoses 230 and 240 in either direction. In particular, provision can be made for the drive elements to be wheels that apply varying amounts of pressure so as to ensure that the hose 230 and/or 240 that is being driven is properly held.

The horizontal portion 210 comprises a base 211 generally fixed to the vehicle 100, and in particular the chassis 102 of the vehicle 100, or as, in the embodiment shown in FIG. 2, the base 211 is fastened on the shell of the tank 110.

Figure 3:
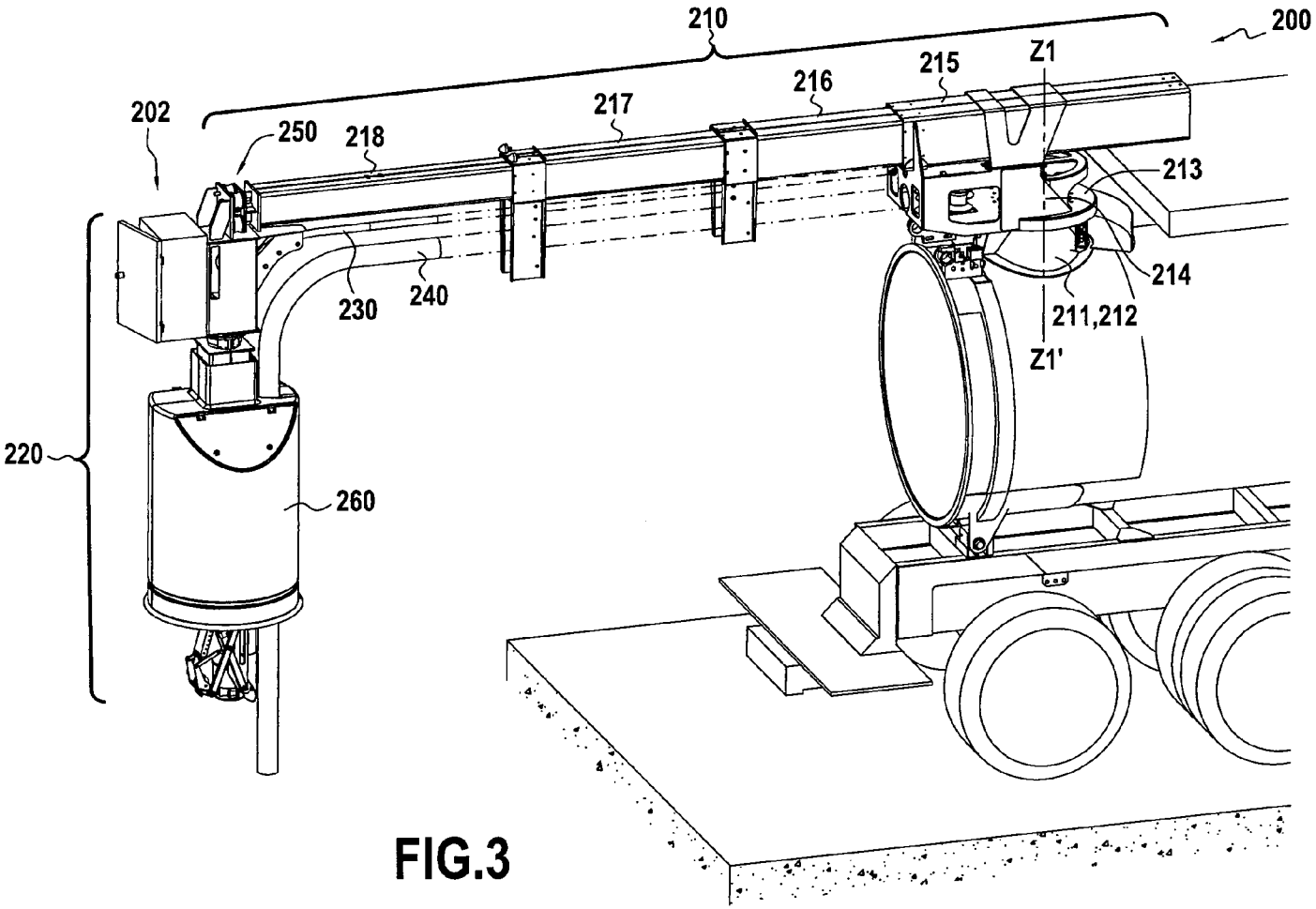
FIG. 3 again shows the rear portion of the vehicle and of the mobile unit, but with the horizontal portion of the telescopic arm being shown deployed.

The base 211 includes a motor 212 identified by its location in FIG. 2, and in particular a hydraulic motor, constituting first drive means that are connected to a first swivel joint 213 (see FIGS. 2 to 4) enabling the arm 202 to turn relative to the base 211 and to the vehicle 100 about a vertical axis Z1-Z1'.

The horizontal portion 210 also has a turret 214 mounted above the swivel joint 213 (see FIGS. 2 to 4) and including roller elements 206 of the guide system 204 (see FIG. 4) for passing the cleaner and suction hoses 230 and 240. The turret 214 can thus be turned about the vertical axis Z1-Z1'.

Above the turret 214, there is mounted a series of beams 215, 216, 217, and 218 having rectangular sections of different sizes, the beams being nested in one another so as to form a telescopic assembly that can move in translation in a horizontal direction (see FIGS. 1 to 4). This movement is driven by a hydraulic actuator (not shown) situated inside the housing 219 defined between the four beams 215, 216, 217, and 218, and forming second drive means that serve to provide drive in horizontal translation (see FIG. 4).

The beams 216, 217, and 218 are connected to parts situated beneath them and that support the roller elements 206 for each of the cleaner and suction hoses 230 and 240, with the suction hose being placed under the cleaner hose.

As can be seen in FIG. 4, the connection between the horizontal portion 210 and the vertical portion 220 is implemented in the form of a hinged bend 250 with a ball joint. More precisely, this connection 250 is a resilient hinge suitable for receiving a large radial load (e.g. of the SPHERIFLEX type) and for accommodating a limited amount of angular movement between the horizontal portion 210 and the vertical portion 220 about the two axes of these two portions 210 and 220, through no more than 150, and preferably through 3° or 5°.

This connection 250 is attached to the beams 218 of the horizontal portion 210 and to the top module 221 of the vertical portion 220. It serves to make it possible, in particular manually, to reestablish proper positioning of the vertical portion 220 in certain situations. Thus, when the road on which the vehicle 100 is standing is on a slope, the angular movement allowed by the connection 250 enables the vertical portion 220 to be placed accurately vertically. Furthermore, if the manhole entrance is obstructed immediately below the bottom module 220, after the vehicle 100 has been parked and the support and guide arm 202 has been deployed, the angular movement allowed by the connection 250 can then serve to tilt the vertical portion 220 a little so as to enable the bottom module 226 to enter into the sewer manhole 300.

The vertical portion 220 comprises firstly a top module 221 formed essentially by a machine-welded part that houses the corresponding portion of the connection 250 in its top end, and third drive means 222 that enable this vertical portion 220 to be driven in vertical translation. For this purpose, the third drive means 222 comprise (see FIG. 4) an electric winch **222*a* associated with a cable 222*b* and a motor 222*c* of the motor and stepdown gear type. Preferably, provision is made for the electric winch 222*a* to be declutchable so as to enable the cable 222*b* that is attached to the bottom portions of the vertical portion 220 that are situated beneath the top module 221 to be rewound manually so as to enable the bottom portions of the vertical portion 220** to be raised in the event of an electrical problem arising.

As also shown in FIG. 4, the top module 221 presents an opening into which the cleaner hose 230 is inserted, while the suction hose 240 remains disposed along but outside the top module 221, under the cleaner hose 230, with these two hoses 230 and 240 being guided in this location by other roller elements 206, in order to bring them into a vertical direction.

In the bottom portion of the top module 221 of the vertical portion 220, fourth drive means 223 are also provided that serve to enable the bottom end of the vertical portion 220 to turn about a vertical axis parallel to the vertical portion 220. In FIG. 5, there can be seen a motor **223*a* associated with a ring 223*b* (e.g. of the ROLLIX type), which is thus made movable in rotation relative to the remainder of the top module 221 so as to constitute a second swivel hinge 223*c*** at this point.

Figure 6:
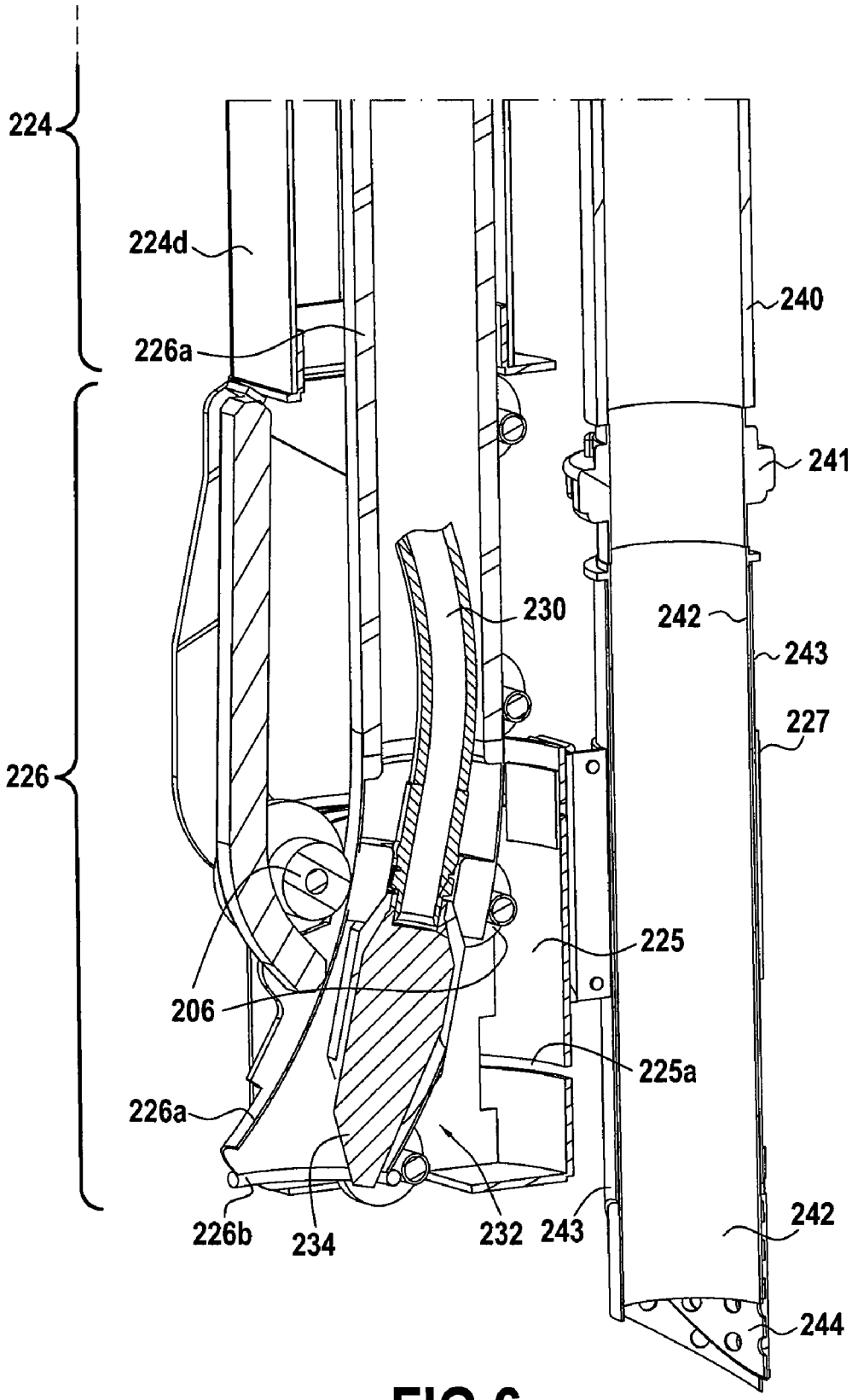
FIG. 6 is a section view showing the bottom end of the vertical portion of the support and guide arm.

Under the top module 221, the vertical portion 220 includes an intermediate module 224 constituted by four beams **224*a*, 224*b*, 224*c*, and 224*d* of rectangular section and of different sizes, that are nested in one another so as to form a telescopic assembly that is movable in translation in the vertical direction (see FIGS. 5 and 6). This movement is driven by the above-described third drive means 222, the cable 222*b* being connected to one or more of the four beams 224*a* to 224*d*** (connection not shown).

In this way, when the motor **222*c* of the third drive means 222 is activated, to drive downwards or upwards, the cable 222*b* drives the set of four beams 224*a*, 224*b*, 224*c*, and 224*d*** vertically, which beams deploy or retract depending on the drive direction.

As can also be seen in FIGS. 5 and 6, at the location of the intermediate module 224, the cleaner hose 230 passes into the inner housing defined by the four beams **224*a*, 224*b*, 224*c*, and 224*d*, while the suction hose 240 remains disposed along but outside the intermediate module 224, and in particular outside the beams 224***a* to 224*d*, with no particular guidance being provided for these two hoses 230 and 240 at the location of the intermediate module 224.

Under the intermediate module 224, the vertical portion 220 has a bottom module 226 that is designed to be placed at the bottom of the sewer manhole 300, sensibly at the location of the invert 304 (flow channel), and that therefore includes the equipment needed for the operations that the mobile unit 200 of the invention is capable of performing.

Firstly, the bottom module 226 has a flexible sleeve 226*a* of section smaller than the section of the inner beam 224*d* of the intermediate module 224 and that is received in an extension 225 of the inner beam 224*d*. More precisely, the sleeve 226*a* extends inside and beneath the set of four beams 224*a*, 224*b*, 224*c*, and 224*d* of the intermediate module 224, such that the sleeve 226*a* serves as a guide for the terminal portion of the cleaner hose 230. The sleeve 226*a* is securely connected to the set of four beams 224*a* to 224*d*, so it moves together therewith. Furthermore, the sleeve 226*a* holds the terminal end of the cleaner hose 230 in such a manner that the position in the vertical direction of the cleaner hose 230 is directly associated with the position of the sleeve 226*a*. The sleeve 226*a* has an opening 226*b* (see FIGS. 6 to 10) into which the cleaner head 234 at the working end 232 of the cleaner hose 230 opens out.

Figure 7:
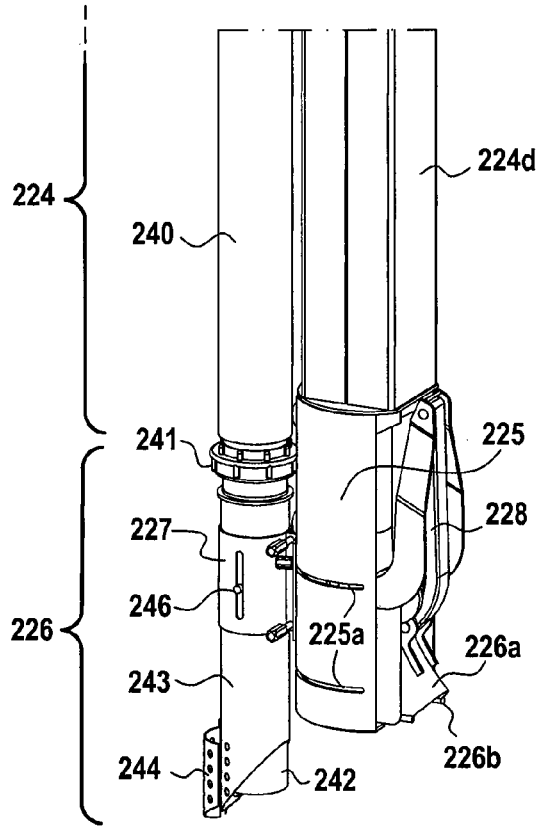
FIGS. 7 and 8 show the bottom module of the vertical portion of the support and guide arm.
Figure 8:
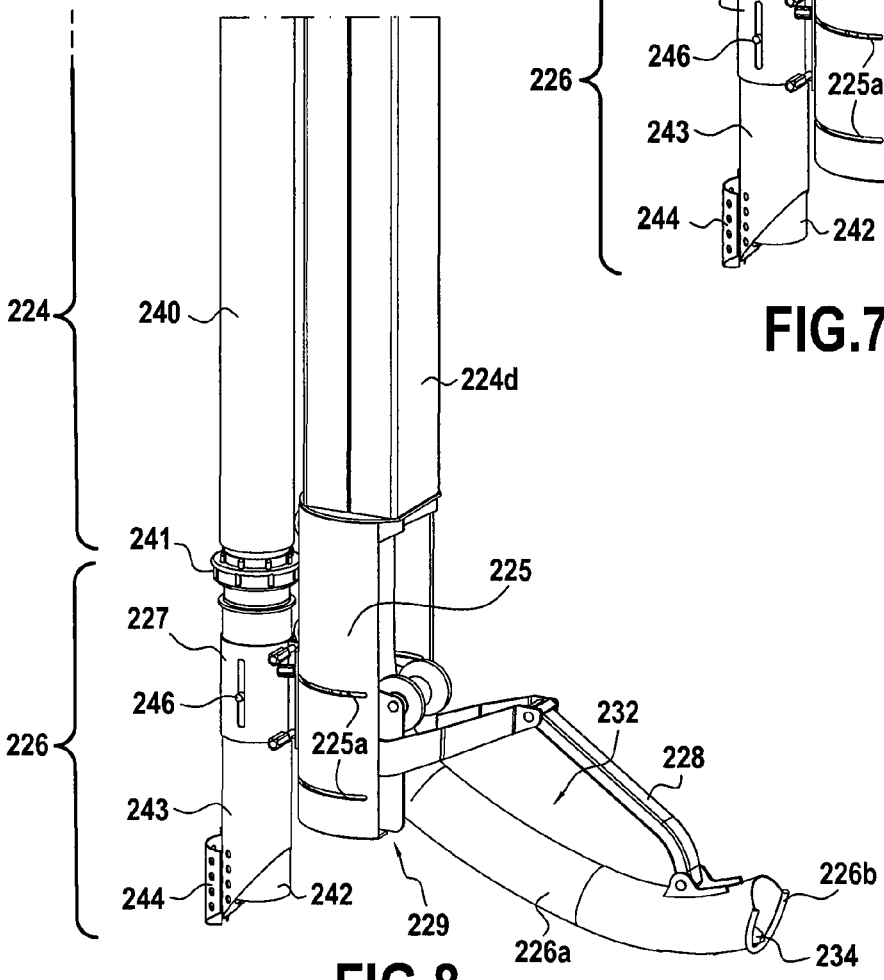
Figure 9:
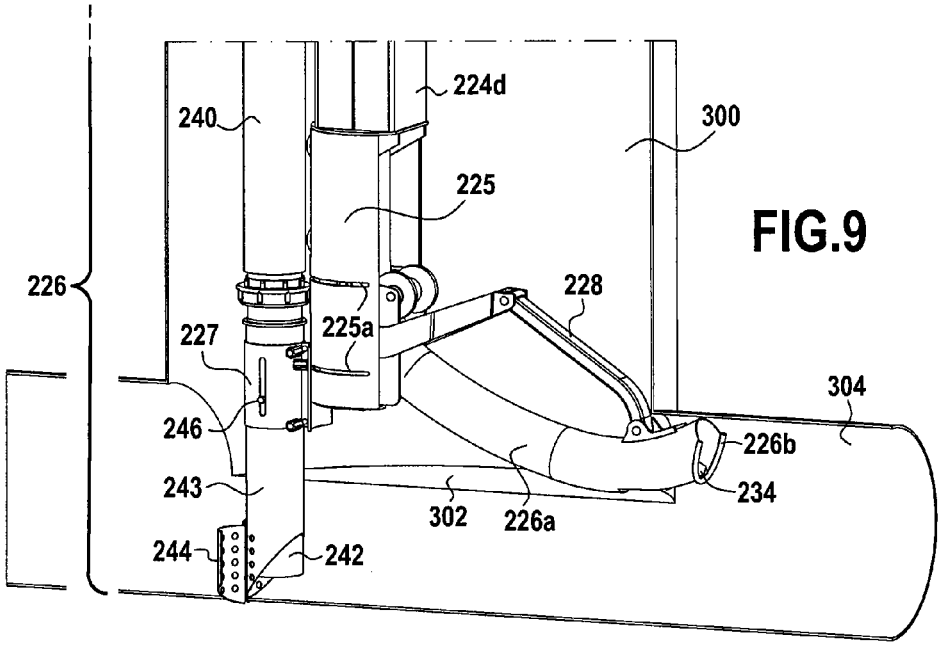
FIGS. 9 and 10, in a manner similar to FIG. 8, show the bottom module of the vertical portion of the support and guide arm, in a position in which the bottom module is situated in the bottom of a manhole, and shown in two different configurations.
Figure 10:
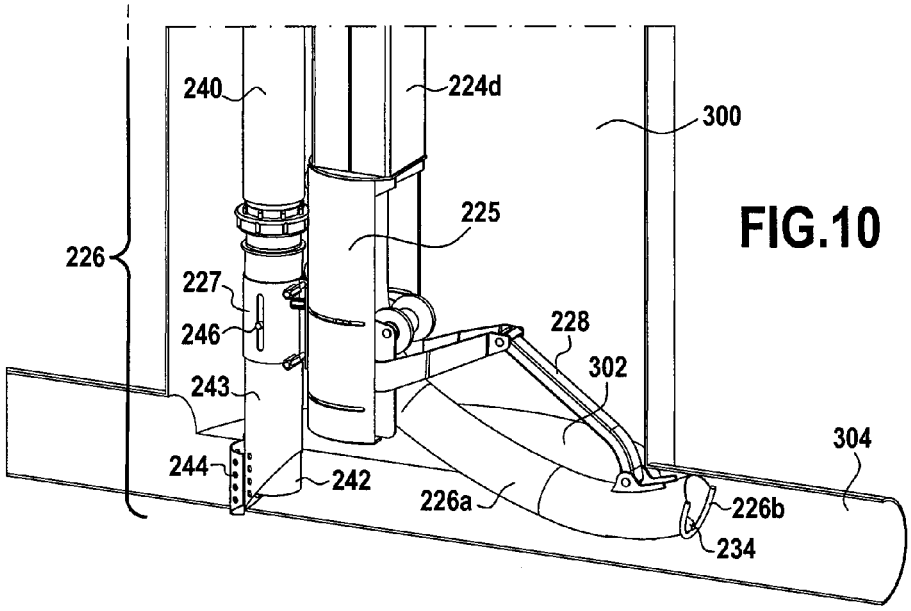

Similarly, the sleeve 226*a* is hinged to pivot about a horizontal axis by means of a leg 228, the sleeve 226*a* moving between a vertical position in which its extends the beams 224*a* to 224*d*, as shown in FIGS. 6 and 7, to a deployed position as shown in FIGS. 8, 9, and 10. The leg 228 comprises a first part pivotally connected to the arm 202 via the extension of the outer beam 224*d* (FIG. 8) and a second part pivotally connected to the free end of the sleeve 226*a*, the first and second parts of the leg 228 themselves being pivotally connected to each other about an axis that is likewise horizontal.

Thus, in its deployed position as shown in FIGS. 8 to 10, the sleeve 226*a* serves not only as a guide for positioning the cleaner head 234 in a more or less horizontal position, but also as a presser member. As shown in FIGS. 9 and 10, the sleeve 226*a* can press against the sidewalk 302 inside the sewer manhole 300 (see FIG. 9) or against the wall of the portion of the channel or invert 304 adjacent to the sewer manhole 300 (cf. FIG. 10).

It can thus be understood that the sleeve 226*a* makes it easier to clean by water-jetting by increasing the stability of the equipment of the bottom module 226, and in particular of the cleaner head 234.

Alternatively, and in a variant that is not shown, the presser member can be made in the form of a tilting bracket using a slideway connection made on the extension of the beam 224*d*, together with retaining rods mounted on the front portion of the bracket, which front portion comes to press against the edge of the invert 304, for example.

The (relatively rigid) cylinder 242 forming the working end of the suction hose 240 is connected to the (more flexible) remainder of the suction hose 240 by a quick-coupling type fastener 241. The cylinder 242 is placed along the bottom module 226, being retained by a ring 227 mounted on an extension 225 of the inner beam 224*d* of the bottom module 226.

To enable the suction hose 240 to be detached, it will be understood that the cylinder 242 is suitable for being extracted from the sheath 243: in this extended position, the cylinder 242, and more generally the suction hose 240, is held to the support and guide arm 202 solely along the horizontal portion 210 of the top module 221 and of the intermediate module 224 of the vertical portion 220 (see FIG. 5), by the roller elements 206 and by the protective bell 260 inside which there passes the suction hose 240 that remains outside the beams 224*a* to 224*d*.

The operations of raising (lowering) the suction hose 240 by the third drive means 222 also serve to extract (insert) the cylinder 242 of the suction hose 240 out from (into) the sheath 243, which sheath may present a flared top segment (variant not shown). The sheath 243 is a cylinder of diameter varying between a maximum diameter allowing the cylinder 242 to be disengaged (inserted) and a minimum diameter blocking the cylinder 242 relative to the sheath 243 by clamping.

The relative vertical position between the cylinder 242 and the sheath 243 is identified by slideway indexing between one (or more) peg(s) 246 and one (or more) vertical groove(s) 227*a* crossing the wall of the ring (see FIGS. 7 to 10).

Likewise, it is possible to orient the position of the suction hose 240 radially about the vertical portion 220 of the arm, and more precisely of the vertical portion of the flexible sleeve 226*a* and the vertical portion of the cleaner hose 230. For this purpose, and as can be seen in FIGS. 7 to 10, the extension 225 is provided with two horizontal grooves 225*a* crossing its wall over an angle at the center of about 180° (enabling adjustment to be made between +90° and −90°), and co-operating with other projecting elements (not shown in the figures) of the ring 227.

An endpiece 244 is fastened to the free end of the sheath 243 and serves as a filter for the material sucked in by the cylinder 242.

Likewise, because of the second swivel hinge 223*c* between the top module 221 and the intermediate module 224, it will be understood that it is possible to orient the position of the intermediate module 224 and thus of the bottom module 226 radially about a vertical axis, thus making it possible to obtain very great accuracy in the positioning of all of the equipment of the bottom module 226, and in particular of the endpiece 244 of the suction hose 240 and also of the cleaner head 234 of the cleaner hose 230.

It should be understood that the cleaner head 234 can be deployed beyond the bottom module 226, in particular beyond the sleeve 226*a*, since the cleaner hose 230 is associated with a motor-driven reel (not shown) situated on the vehicle 100.

Finally, the mobile unit 200 also includes a mobile protection bell 260 surrounding the intermediate module 224 and that serves, when the bottom module 226 is deployed in the sewer manhole 300, to move down onto the manhole, so as to protect the operator. Advantageously, the bell 260 has a transparent top wall portion so as to make it possible to see the operations taking place inside the manhole 300.

The vertical portion 220 further comprises, in a housing (not shown) mounted inside the protection bell 260, a camera module (not shown) suitable for leaving the above-mentioned housing to view the state of the manhole 300 before and/or after cleaning, comprising washing under a high pressure jet of water delivered through the cleaner head 234, and then suction via the endpiece 244 of the suction hose 240. For this purpose, such a camera module has its own control system and its own drive system enabling it to move from the bell 260 towards and into the manhole 300, independently of the movements of the vertical portion 220 of the arm 202.

In addition to the first viewing means, the mobile unit 200 may also include a retractable support (not shown) on which it is possible to place a moving camera forming a detachable vehicle of the bottom module 226 capable of going to examine and check the state of the network beyond the location of the sewer manhole 300.

The mobile unit 200 includes a control system for controlling all of the moving equipment, in particular the first, second, third, and fourth drive means for the support and guide arm 202, and also for the suction hose 240, the cleaner hose 230, the camera module, and the optional moving camera support.

From the above, it will be understood that at the support and guide arm 202, the elements that enable the intermediate module 224 and the bottom module 226 to turn, are disposed at the top portion of the set of three modules 221, 224, and 226 of the support and guide arm 202. This avoids placing mechanical elements, and in particular moving mechanical elements that are bulky in the portion of the support and guide arm 202 that is positioned inside the manhole 300.

Furthermore, the bottom module 226 of the support and guide arm 202 contains only those technical elements (and in particular mechanical elements) that are essential for this location, so as to avoid them being subjected to stresses associated with dirt, moisture, and impacts that are likely to occur when operating inside the manhole.

The tanks for containing firstly clean water for the high-pressure water-jet (water tank) and secondly for containing the sludge and dirty water sucked in by the suction hose (collector tank) can be constituted by a single vessel 110 having an optionally displaceable separator partition.

Alternatively, the water tank is separate from the collector tank, which tank may be fitted with an ejector piston to make it easier to empty.

What is claimed is:

1. A mobile unit for cleaning a sewer network from a manhole, the unit comprising:

a suction hose mounted on a reel and connected to a collection tank and to a suction pump;

a high-pressure cleaner hose mounted on a reel and connected to a water tank, to a high-pressure pump, and to a cleaner head;

a support and guide arm for supporting and guiding the suction hose and the cleaner hose, said arm comprising a horizontal portion connected to the mobile unit and being movable to swivel about a vertical axis and in horizontal translation relative to the mobile unit so as to enable working ends of the suction and cleaner hoses to be positioned above the sewer manhole, said arm further comprising a vertical portion connected to the horizontal portion, the connection between the horizontal portion and the vertical portion of the arm forming a bend hinged by a ball joint and said vertical portion presenting a bottom module that is movable in swiveling and in vertical translation relative to said horizontal portion, said vertical portion further comprising a top module connected to the horizontal portion that presents first drive means suitable for driving the vertical translation movement of the bottom module;

the suction and cleaner hoses being connected to said bottom module, whereby the positioning of the bottom module corresponds substantially to the positioning of the working ends of the suction and cleaner hoses.

2. A unit according to claim 1, wherein the ball joint allows the horizontal portion and the vertical portion to move relative to each other through a maximum angle of 5°.

3. A unit according to claim 1, wherein the ball joint allows the horizontal portion to move angularly relative to the vertical portion through a maximum angle of 15°.

4. A unit according to claim 1, wherein the horizontal portion of the arm includes second drive means and a first swivel joint enabling said swiveling movement about a vertical axis relative to the mobile unit, the horizontal portion of the arm further including third drive means and a plurality of beams nested in one another and suitable for performing said horizontal translation movement of the horizontal portion of the arm by telescopic displacement between the beams, under drive from said third drive means.

5. A unit according to claim 1, wherein the vertical portion of the arm further includes a swivel joint having a ring and second drive means for driving swiveling movement about a vertical axis of the bottom module.

6. A unit according to claim 5, wherein the vertical portion of the arm further includes an intermediate module situated between the bottom module and the top module, being connected to the ring of the swivel joint, and comprising a plurality of beams nested in one another and suitable for performing said vertical translation movement of the vertical portion of the arm by telescopic movement between the beams driven by said first drive means of the top portion, whereby the bottom module is driven with the same vertical translation movement, one of the beams of the intermediate module being fastened to the ring of the second swivel joint.

7. A unit according to claim 1, wherein the suction hose is detachably connected to said vertical portion of the arm.

8. A unit according to claim 1, wherein the bottom module is provided with a ring enabling the suction hose to be held so that it follows the movements of the bottom module.

9. A unit according to claim 1, wherein the bottom module enables the suction hose to be offset about the cleaner hose with radial indexing.

10. A unit according to claim 1, wherein the horizontal and vertical portions of the arm are provided with a system for guiding the suction hose and/or the cleaner hose via roller elements.

11. A unit according to claim 1, further including a protection bell movable in vertical translation about the vertical portion of the arm and suitable for surrounding the arm over the manhole.

12. A unit according to claim 11, wherein the protection bell further includes a camera module movable at least vertically relative to the support and guide arm and enabling the inside of the manhole and adjacent channel zones to be viewed.

13. A unit according to claim 12, wherein said camera module is connected to a data acquisition and/or display system via a cable running along support and guide arm.

14. A unit according to claim 11, wherein the protection bell forms part of the intermediate module.

15. A unit according to claim 11, wherein the protection bell is servo-controlled to the movement of the cleaner hose.

16. A unit according to claim 1, wherein the bottom module further includes a support suitable for receiving an autonomous carriage fitted with a mobile camera.

17. A unit according to claim 1, wherein the bottom module further includes a deployable presser member suitable for coming into contact with the structure of the manhole.

18. A vehicle including a mobile cleaner unit according to claim 1.

19. A unit according to claim 1, wherein the bottom module is movable in swiveling about a vertical axis relative to said horizontal portion.

* * * * *